US005392580A

United States Patent [19]

Baumann

[11] Patent Number: 5,392,580

[45] Date of Patent: Feb. 28, 1995

[54] MODULAR REINFORCEMENT CAGES FOR DUCTILE CONCRETE FRAME MEMBERS AND METHOD OF FABRICATING AND ERECTING THE SAME

[76] Inventor: Hanns U. Baumann, 312 Emerald Bay, Laguna Beach, Calif. 92651

[21] Appl. No.: 879,971

[22] Filed: May 6, 1992

[51] Int. Cl.[6] ..... E04C 5/00

[52] U.S. Cl. ..... 52/660; 52/646; 52/653.1; 52/649.1

[58] Field of Search ..... 52/250, 251, 252, 653.1, 52/653.2, 253, 414, 677, 649.1, 649.2, 649.3, 660–665, 686, 646; 211/151, 70.4; 256/1

[56] References Cited

U.S. PATENT DOCUMENTS

| | | | |
|---|---|---|---|
| 865,336 | 9/1907 | Gardner | 52/253 |
| 1,389,942 | 9/1921 | Freyssinet | 52/662 |
| 1,512,763 | 10/1924 | Holmgren | 52/660 |
| 1,748,843 | 2/1930 | Kuckel | 211/151 |
| 1,911,018 | 5/1933 | Goeltz | 52/646 |
| 2,766,016 | 10/1956 | Miller et al. | 256/1 |
| 2,815,656 | 12/1957 | Klein et al. | 72/16 |
| 3,003,290 | 10/1961 | Lerner | 50/407 |
| 3,221,463 | 12/1965 | Schoch | 52/665 |
| 3,238,684 | 3/1966 | Wood | 52/481 |
| 3,245,189 | 4/1966 | Reiland | 52/649.2 |
| 3,269,557 | 8/1966 | Wahl | 211/151 |
| 3,331,179 | 7/1967 | Ernst et al. | 52/686 |
| 3,378,981 | 4/1968 | Horne | 52/677 |
| 3,473,285 | 10/1969 | Reiland | 52/649.3 |
| 3,604,180 | 9/1971 | Wood | 52/653 |
| 3,611,665 | 10/1971 | O'Brien | 52/723 |
| 3,744,207 | 7/1973 | Oroschakoff | 52/664 |
| 3,916,592 | 11/1975 | Morohashi et al. | 52/252 |
| 4,280,310 | 7/1981 | Tolliver | 52/646 |
| 4,409,764 | 10/1983 | Wilnau | 52/127.3 |
| 4,454,702 | 6/1984 | Bonilla-Lugo et al. | 52/745 |
| 4,838,726 | 6/1989 | Lucas Huerta | 403/397 |

FOREIGN PATENT DOCUMENTS

| | | | |
|---|---|---|---|
| 3-90760 | 4/1991 | Japan | 52/721 |

OTHER PUBLICATIONS

"Building Code Requirements For Reinforced Concrete etc." by ACI Committee 318–Standard Building Code, Nov. 1989, pp. 309, 311–314, 319–321.

"Notes on ACI318–83 Building Code Requirements for Reinforced Concrete" pp. 30–12, 30–14, 30–20, 30–30, 30–35, 30–36, 30–93.

"Earthquake Design of Concrete Masonry Buildings": vol. 1: Response Spectra Analysis and General Earthquake Modeling Considerations, by Robert E. Englekirk et al, Shear Wall Response Using Inelastic Response Spectra–pp. 91–105.

"Lessons Learned from Recent Earthquakes and Research and Implications for Earthquake-Resistant Design of Building Structures in the United States", Earthquake Spectra, vol. 2, No. 4, 1986, pp. 825–826, 853, 856.

"Earthquake-Resistant Design", Section 3, by N. M. Newmark et al., pp. 3–1 through 3–27.

Uniform Building Code, 1988 Edition, 2624–2625, pp. 492–501.

*Primary Examiner*—James L. Ridgill, Jr.

*Attorney, Agent, or Firm*—Stetina Brunda & Buyan

[57] ABSTRACT

A generally rectangular wire grid of welded construction is utilized to define and maintain the positioning of rebar charged therethrough during the formation of structural column and girder cages. Pre-positioned ties guide the rebar through the grid. The pre-positioned ties are then tightened such that the rebar is held firmly in place at the close tolerance positions defined by the prefabricated grid. A plurality of such grids are assembled into expandable bundles such that they may be expanded in an accordion-like fashion about rebar charged therethrough, resulting in properly spaced grids for defining and maintaining the position of the rebar. Additional rebar members may then be charged therethrough to complete the construction of a column or girder cage. The modular reinforcement cages of the present invention thus eliminate piecemeal engineering requirements by providing modular building concepts in which a unique rebar bundle pattern facilitates improved containment.

18 Claims, 7 Drawing Sheets

Fig. 4
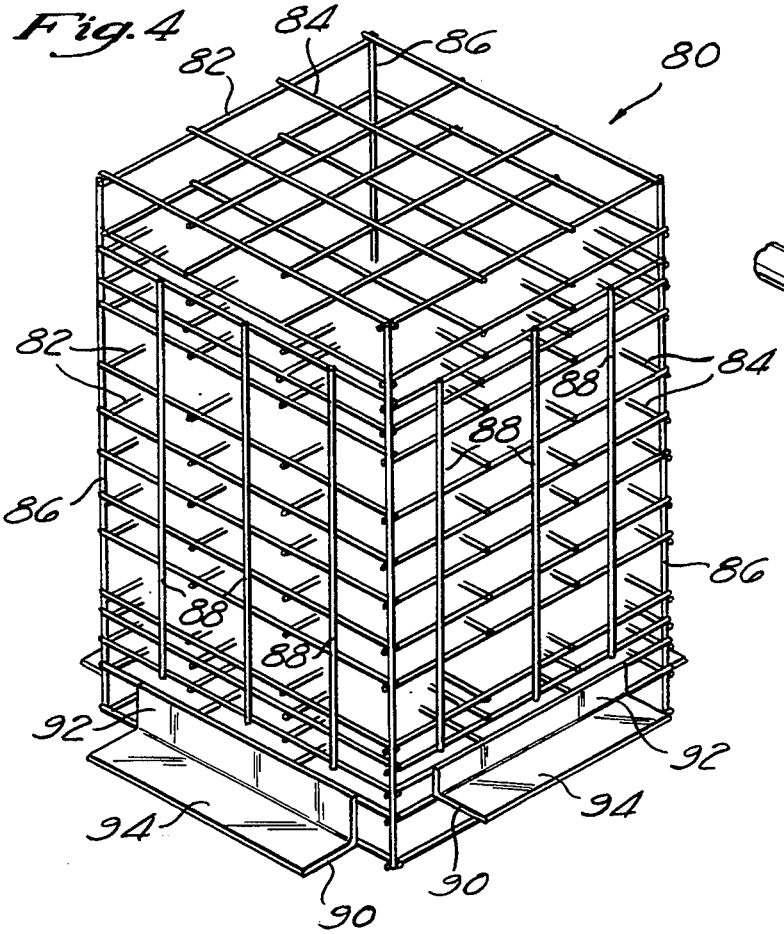
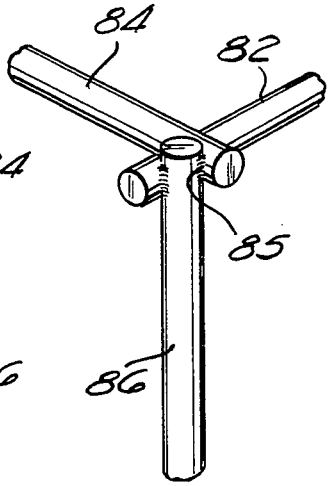
Fig. 4a
Fig. 5
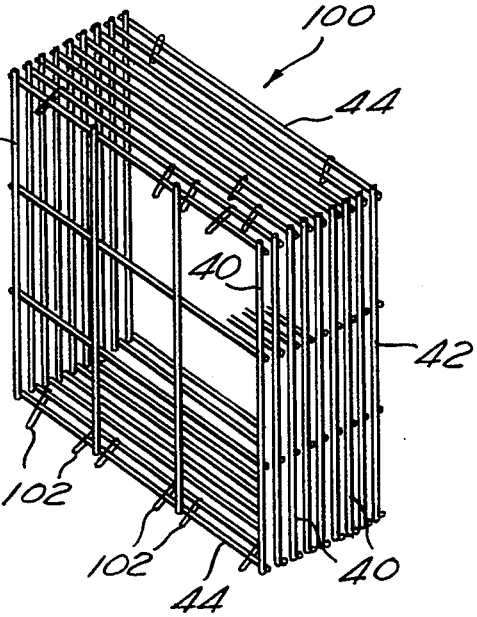
Fig. 5a
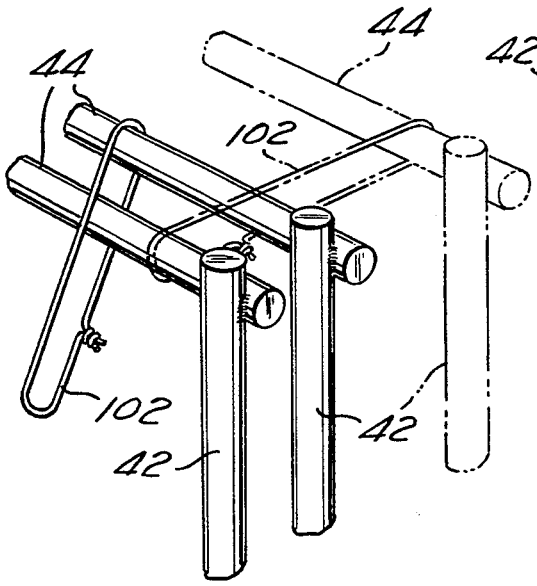

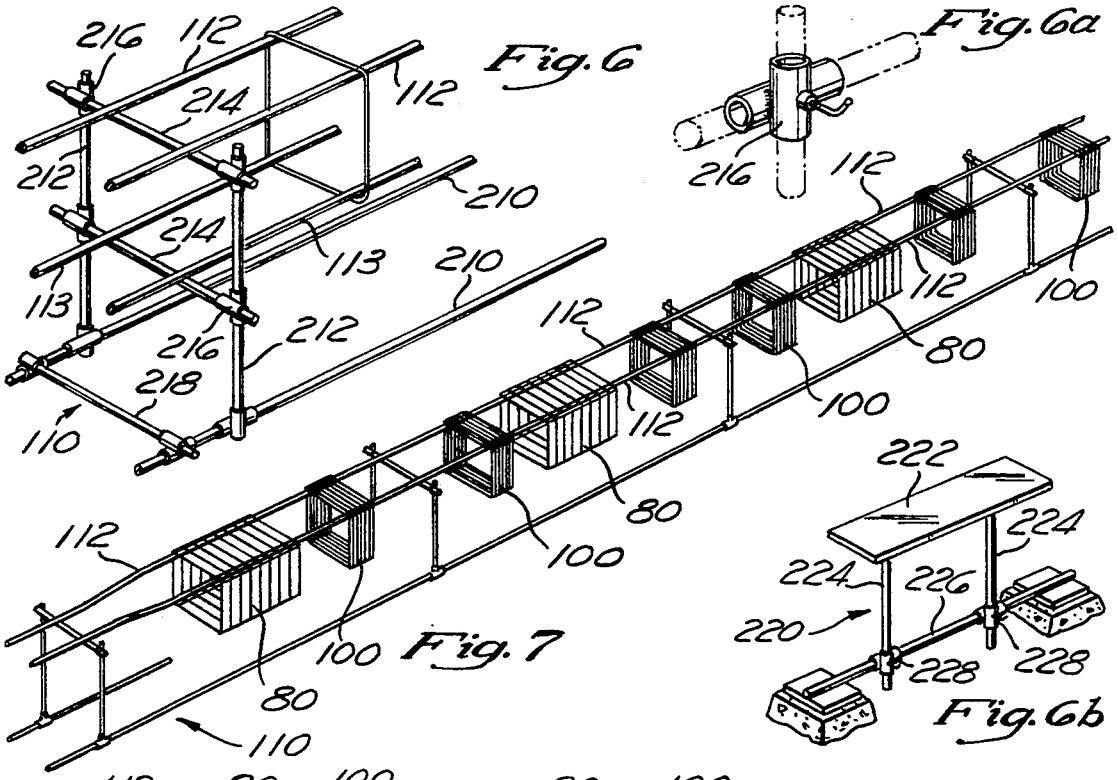
Fig. 6
Fig. 6a
Fig. 7
Fig. 6b
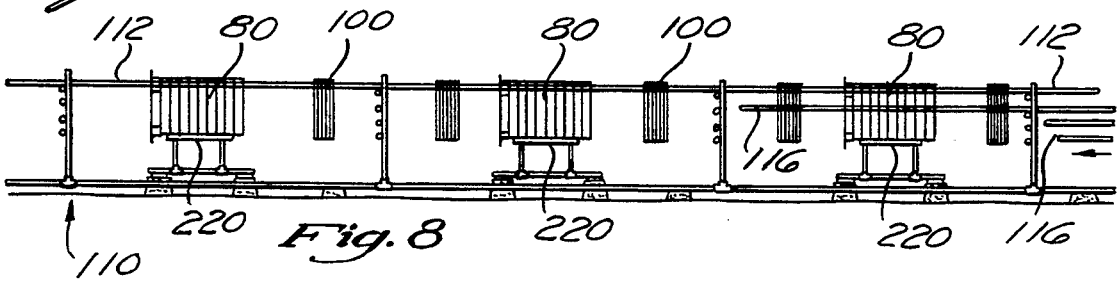
Fig. 8
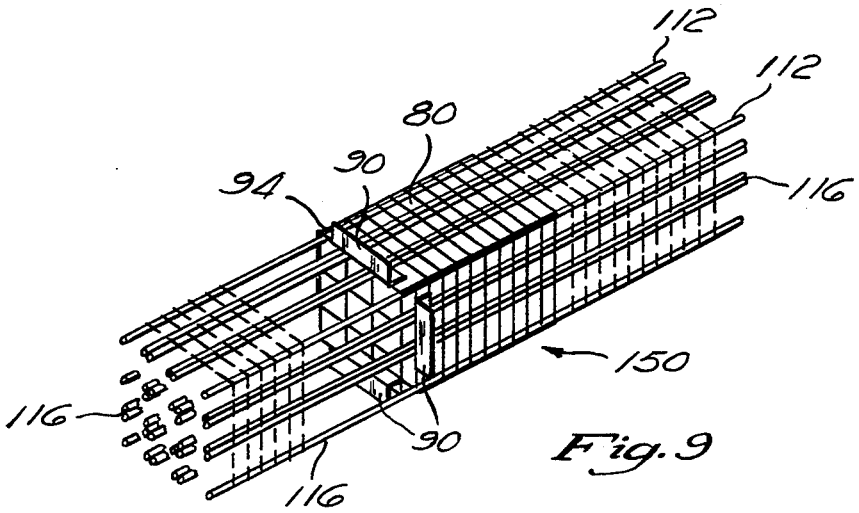
Fig. 9

Fig. 10
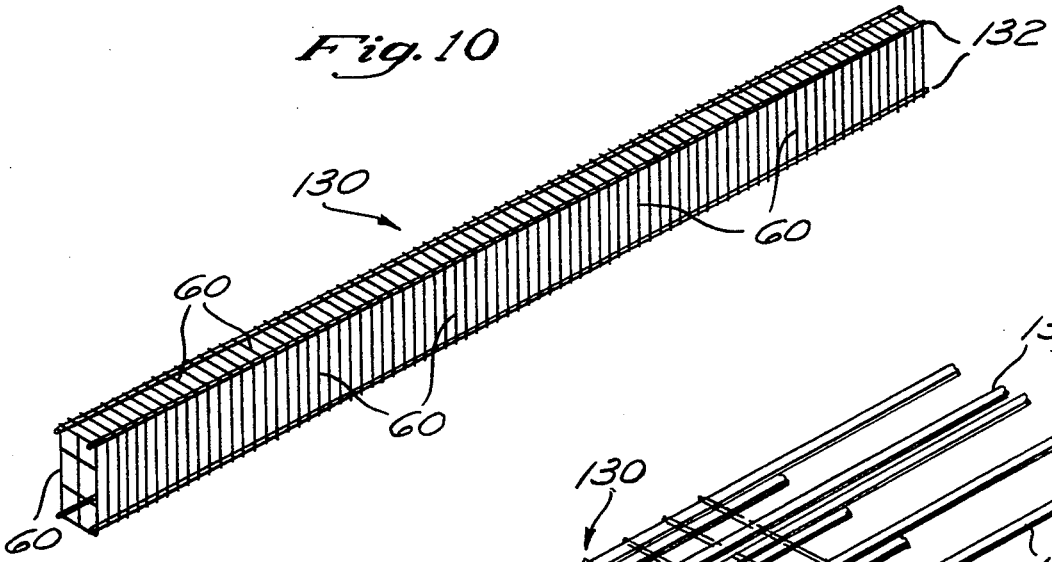
Fig. 11
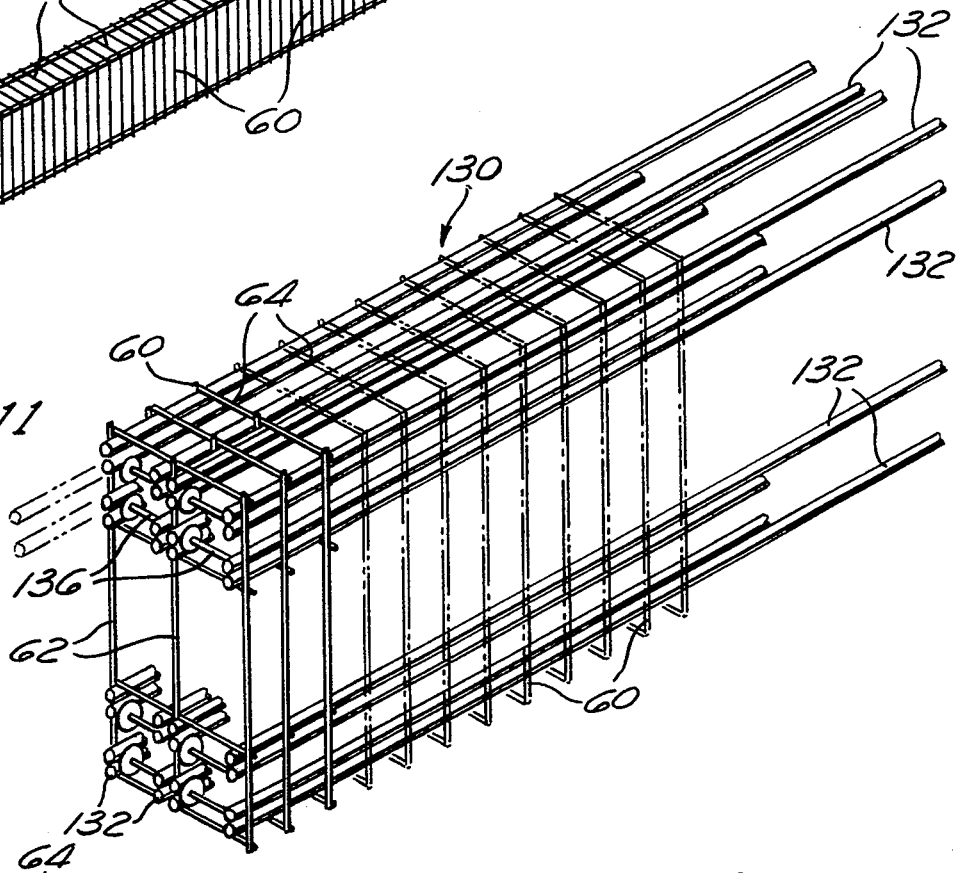
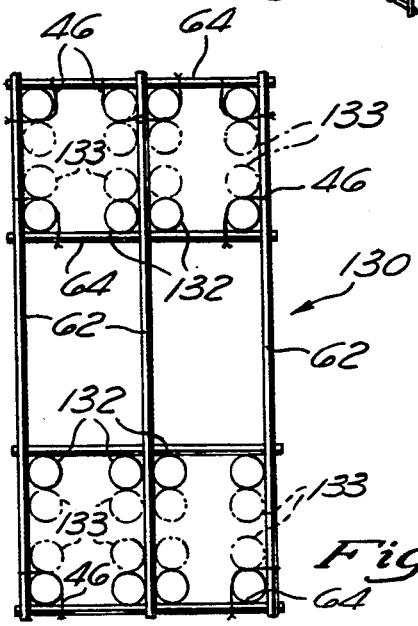
Fig. 13
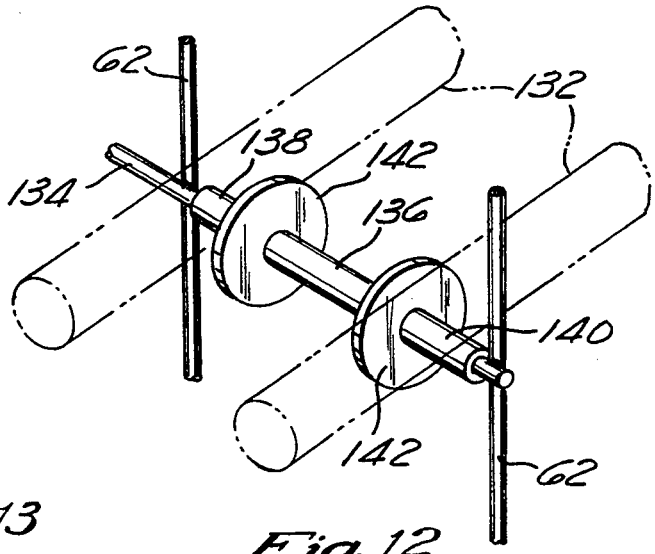
Fig. 12

MODULAR REINFORCEMENT CAGES FOR DUCTILE CONCRETE FRAME MEMBERS AND METHOD OF FABRICATING AND ERECTING THE SAME

FIELD OF THE INVENTION

The present invention relates generally to building construction and more particularly to a ductile reinforced concrete frame comprising prefabricated welded grids for defining and maintaining the position of rebar charged therethrough such that high tolerances are maintained, metal usage is minimized, and improved structural strength is obtained. Ductility is improved, thereby reducing the amount of earthquake resisting material required by reducing the seismic forces that the structure must resist. The present invention thus provides a unique rebar bundle pattern for improved confinement. Modular building concepts eliminate piecemeal engineering requirements.

BACKGROUND OF THE INVENTION

Frames comprised of reinforced concrete columns and girders for constructing buildings are well known. Such contemporary columns and girders are commonly constructed by first forming a latticework of rebar, i.e., a cage, which reinforces and contains the concrete. The cage, generally defining the column or girder, is surrounded by a form, commonly constructed of steel or fiberglass. Concrete is then poured into the form such that the cage is encapsulated thereby. The concrete is then typically vibrated to remove any voids formed therein. The form may be constructed in place such that the resulting column or girder need not be moved after the concrete cures. Alternatively, the form may be constructed at a convenient location, and the column or girder thus fabricated subsequently moved to its final location.

In multi-level commercial buildings, the steel latticeworks or cages for such columns and girders are commonly constructed by first disposing a plurality of elongate members or rebar upon a series of supports or horses and then positioning a plurality of sections of smaller diameter rebar or wire formed into generally rectangular hoops about the larger elongate rebar members to generally define the desired cage. Further elongate members may then be charged through these rectangular hoops and secured in position via wire ties.

As can be appreciated, this process is extremely labor intensive. Additionally, very loose tolerances, typically approximately ½ inch, are maintained due to the difficult nature of handling and aligning such materials. Thus, the lateral position of an elongate rebar member at the intersection of one rectangular hoop may vary by as much as ½ inch relative to its position at the intersection of another rectangular hoop. Such large tolerances are not desired. They are tolerated by building codes because of the present-day method of preforming the hoops and hooked cross-ties.

Typically such columns and girders are formed in thirty foot lengths, which are commonly required in building construction. Splice bars are shorter lengths, typically approximately sixteen feet, of rebar which are wire tied to the abutting ends of adjacent columns such that they may be joined thereby. As can be appreciated, such splicing greatly increases material usage, weight, and cost as well as requires substantial labor in the practice thereof. Column bars are spliced by overlapping their offset ends. Girder bars are usually just capped.

The need for frame structures to exhibit a comparatively high degree of ductility is particularly important in geographic locations known to experience substantial seismic activity. In such geographic locations it is not uncommon for frame structures to experience sufficient force to cause crushing or brittle failure of the concrete during seismic activity. Such crushing or brittle failure may result in catastrophic failure of the structural member.

For example, a portion of the encapsulating concrete may break away as a result of seismic activity. The breaking away of such a portion of the encapsulating concrete may then expose a portion of the rebar latticework or cage, allowing it to degrade from environmental factors, i.e. moisture, smog, etc., and also allowing it to move outward due to the lack of a retaining effect provided by the encapsulating concrete.

Furthermore, rectangular hoops are subject to rupture or breakage upon experiencing substantial seismic forces. Such substantial seismic forces may urge the rebar restrained by the rectangular hoop outward with sufficient force to pull apart the bent ends of the rectangular hoop. Columns using cross-ties with 90-degree bends, when subjected to bending and axial forces, have exhibited brittle failures caused by the 90-degree bends straightening out. Also intermediate longitudinal bars between cross-ties buckle outward due to lack of positive confinement, thus causing a brittle failure of the concrete. Thus, such construction is inadequate for use in geographic locations known to experience substantial seismic activity.

The prior art construction methods are thus labor intensive, require excessively large tolerances, utilize 90-degree bends which are failure prone, and additionally utilize intermediate bars which tend to buckle prematurely.

As such, although the prior art has recognized, to a limited extent, the problem of fabricating structural members such as columns and girders in a manner which will withstand substantial seismic forces, the proposed solutions have to date been in effective in providing a satisfactory remedy.

SUMMARY OF THE INVENTION

The present invention specifically addresses and alleviates the above mentioned deficiencies associated in the prior art. More particularly, the present invention comprises dimensionally stable structural frames utilizing generally rectangular wire frames or grids, preferably of welded construction, to replace the prier art hoops and to define and accurately maintain the positioning of rebar members charged therethrough. Pre-positioned ties guide the rebar through each grid. The pre-positioned ties are then tightened such that the rebar is held firmly in place at the close tolerance positions defined by the prefabricated grid.

A plurality of such grids may optically be assembled into laterally expandable cages or grid bundles such that they may be expanded in an accordion like fashion about rebar members charged therethrough. Positioner devices, preferably wire loops, define the relative positions of the grids once the bundle is expanded. This results in properly spaced grids for defining and maintaining the position of the rebar in the finished cages. Additional rebar members may then be charged through the grid bundles prior to expansion thereof to complete the construction of a column or girder cage. Such rebar members are attached to the grids via ties, preferably formed of wire. The cage is disposed within a form and the form is then filled with concrete to complete the fabrication of a column or girder.

Bundles of grids with positioner devices attached can alternatively be expanded first and then have longitudinal rebar members charged therethrough, instead of being charged first and then expanded as described above. As a further alternative, only key, i.e., two upper corner, rebar members are charged through the bundle first. Subsequently, the bundle is expanded and then the remaining bars are charged therethrough.

The grids are of integral construction such that they need not be assembled at the job site. Thus, each of the individual members of the grid are permanently interconnected, i.e., by welding, to one another such that interconnection need not be performed by construction personnel. Those skilled in the art will recognize that various other means of forming such integral grids are likewise suitable. For example, integral grids can be formed by forging, molding, machining, the use of bolts or other fasteners, etc.

For certain special applications such as reinforced columns using high strength concrete, the grids are made of prewelded elongated hoops of paperclip-like configuration positioned at 90-degree orientation to one another. Longitudinal reinforcement is charged through the ends of these hoops. Grids or hoops could be made of other materials, such as graphite pultrusion, etc.

The use of such prefabricated grids eliminates a substantial portion of the labor required in the fabrication of structural members such as columns and girders utilized in the construction of building frames. Additionally, the high tolerances, typically within approximately 1/16 inch, afforded by the use of such prefabricated grids substantially enhances the structural strength and ductility of the building frames fabricated therewith and additionally reduces the quantity of material required for such fabrication. Vastly improved ductility reduces the amount of material required to resist earthquake forces in the entire building structure.

Interconnection modules facilitate the convenient attachment of girders to columns to allow rapid charging of splice bars through the girder and column cages. A ledge formed along the lower surface of the interconnection module provides vertical alignment of the cage attached thereto and supports the cage during the attachment process. Alignment members facilitate horizontal alignment of the cage by providing an easily observable indication of horizontal alignment. Thus, the girder cage or precast girder need merely be placed upon the ledge of the interconnection module and positioned in alignment with the alignment members to facilitate correct alignment thereof, greatly reducing the amount of labor involved in the attachment process.

Rollers positioned upon the interconnection module and/or the prefabricated grids of the column cage or girder cage facilitate charging thereof. Such rollers both act as guides for charging and also substantially reduce the amount of work required by allowing the rebar thus charged to roll thereover, thus reducing friction.

Two types of rollers are disclosed. A first or spool-type of roller comprises partitions for separating and properly positioning two or more rebar members. Spool-type rollers are attachable to the interconnection modules and/or the grids of columns or girders during the fabrication process, prior to the completion of welding. Snap-on split-sleeve rollers may be attached at any time. Both spool-type and snap-on split-sleeve rollers are preferably fabricated of steel. However, those skilled in the art will recognize that various other materials, i.e., plastic, are likewise suitable.

The split-ring snap-on rollers may be conveniently attached to the grids of columns and girders when and where required. Split-rings snap-on rollers are configured as a generally cylindrical sleeves having a split formed longitudinally therein such that the sleeve may be pried open by manually enlarging the split therein. This allows the sleeve to be positioned upon a wire member or the like and the sleeve then closed by bending the split shut.

Use of the spool-type rollers and split-ring snap-on rollers in various combinations are contemplated. For example, the spool-type rollers may be used at intervals along a column or girder to maintain alignment of the rebar charged therethrough during the charging process while split-sleeve snap-on rollers are used intermediate adjacent spool-type rollers to reduce friction and thereby further improve the charging process.

Threaded couplings may optionally be used to attach adjacent columns and/or girders. The threaded couplings are initially threaded completely onto threaded portions of rebar extending from a first structural member. The threaded portions of rebar of the first structural member are then aligned with corresponding threaded portions of rebar of a second structural member such that the threaded portions of rebar abut. The threaded couplings are then twisted such that they thread onto the threaded studs of the second structural member. When the threaded couplings are positioned such that they envelope approximately equal portions of the threaded studs of both structural members, attachment is complete.

A substantial savings in weight is realized in the practice of the present invention because the use of the prefabricated grids eliminates a substantial portion of the rectangular hoops utilized in the prior art construction of the steel latticework. The ends of the hoops, which are typically bent inwards about a rebar member, are not present in the grids of the present invention. Because of the large number of such rectangular hoops utilized in the construction of any given structural member, this savings is substantial. Additionally, the welded construction of the grids reduces the number of wire ties required. Additionally, the use of high strength wire ties for reinforcing the column and girder grids results in a substantial weight reduction.

Strength and ductility is improved since every rebar member is confined within a welded corner or welded T intersection of a grid when the cages are formed. There are no non-welded or weak corners in the present invention which are particularly subject to failure during seismic activity.

Because of the accuracy with which the steel reinforcing lattices of the present invention are formed, they do not tend to distort or corkscrew as they are being erected. Such distortion or corkscrewing represents a substantial problem in the prior art. It makes the fabrication and handling processes substantially more difficult and prevents uniform construction of the structural members. The resulting rigidity and high tolerance construction of the steel latticeworks of the present invention therefore substantially enhance and improve the erection process. Thus, the erection process requires substantially less time and is consequently less costly.

The prior art, using structural steel columns, is at a disadvantage because the structural steel columns resist earthquake forces in only one direction. Also, steel anide flange columns have a weak axis which reduces their ability to support gravity loads. The present invention, on the other hand, allows for the maximum number of principal reinforcement bars to be arranged near the four outside edges of the concrete column where they will be efficiently resisting both axial gravity and bending moments, caused by lateral forces in both orthogonal directions. At the same time the present invention allows the girder bars to pass through the column in a modular configuration.

By using bundled bars in both the column cage and the girder cage, the present invention provides a modular way to arrange reinforcement bars so that they can pass each other very efficiently in a four-way column-girder joint.

At the same time the rebar arrangement provides for confinement of every rebar member, which is not the case in the prior art.

This positive confinement of every column and girder rebar member is achieved and the closely spaced orthogonally oriented high strength wires in the column and girder grids are ideally positioned to resist the bursting forces created in the joint which cause brittle failures of reinforced concrete joints.

The configuration of the present invention provides for the equivalent of an external hydrostatic pressure of several thousand psi. This new pattern of intersecting vertical and horizontal bars confined with orthogonally oriented high strength wires at very close spacing creates a new type of concrete frame which will allow the safe use of reinforced concrete in much taller buildings in seismic zones. At the same time, by automating the fabrication and erection of these highly ductile concrete frames, the cost of these tall buildings will be substantially less while their resistance to earthquakes will be substantially greater. This new pattern of reinforcement and confinement thus allows much stronger frames to be constructed whose members are significantly smaller in dimension.

Thus, for taller buildings, less rentable space is lost to columns and girders in the present invention. In addition, because of the vastly increased ductility of this new kind of concrete frame, much less principal reinforcing steel and concrete in both columns and girders is required. This, in turn, reduces the dead weight of the building which further reduces the lateral earthquake forces and gravity loads.

Thus, the present invention has a three-fold advantage over prior art in both concrete and structural steel. The first is that rebar pattern allows for more reinforcement in smaller members. The second is that vertical and horizontal rebar members pass through the joint in an efficient modular way which makes erection much faster. The third is that the present column rebar pattern allows the column to resist lateral forces from both orthogonal directions, while at the same time resisting axial forces more efficiently even though it is smaller.

These standard modular columns and girder cages are all predesigned to fit together without interference while erecting. Also these standard modular columns and girders will best tested so that each has a known ductility ratio and known capacity.

During computerized analysis and design, the standard modular girder cage and column cage pattern is selected for each member based on its previously tested ultimate capacity. Computerized shop drawings, including bill of materials, may be prepared using the standard modular patterns of intersecting girder and column reinforcement and of the adjustable forms. A complete computerized material take-off and labor or equipment estimate can then be prepared using the information generated during preparation of the shop drawings.

Computerized fabrication of the grids and principal reinforcement with ends offset can be accomplished. Computerized fabrication or joint cubes and grid bundles can then be performed as the final operation in the shop. In the field or in the shop, a computerized cage assembly machine can assemble the cages.

The modular reinforcement cages for ductile concrete frame member of the present invention thus provide a unique rebar bundle pattern for improved confinement. This results in structural members which are less susceptible to the forces generated by earthquakes.

A building structure utilizing the present invention can be safely designed and constructed with approximately half the amount of earthquake resisting material than is required in the prior art, which does not have the ability to have the core concrete strained without battle failure.

Furthermore, the improved dimensional tolerance and standardized construction techniques facilitated by the present invention lend the structural members formed thereby to the use of automation, i.e. robotics. Thus, the present invention both represents a substantial advance in the art and facilitates such further advances.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 4 is a perspective view of an interconnection module for interconnecting a plurality of girders and/or columns according to the present invention;

FIG. 4*a* is an enlarged view of three representative intersecting rebar members of FIG. 4, illustrating the welded construction of the positioner wire;

FIG. 5 is a perspective view of a collapsed expandable cage or grid bundle constructed of the grids of FIG. 2 interconnected via loops such that the bundle may be expanded so as to properly position the rectangular grids relative to one another;

FIG. 5*a* is an enlarged view of the corner portion of two of the rectangular grids of FIG. 5 illustrating the expansion thereof;

FIG. 6 is a perspective view of a horse supporting four rebar members;

FIG. 6*a* is an enlarged perspective view showing the adjustable interconnection of two members of the horse of FIG. 6;

FIG. 6*b* is an enlarged perspective view of a grid bundle support of FIG. 8;

FIG. 7 is a perspective view of the overall column fabrication process showing two sections of rebar held in position by a plurality of horses, the rebar sections having expandable cages or rebar bundles and interconnection modules depending therefrom;

FIG. 8 is an elevational side view of the column fabrication process of FIG. 7 additionally illustrating the charging process;

FIG. 9 is an enlarged perspective view of an interconnection module of FIG. 7 having rebar members charged therethrough as in the fabrication of a column cage;

FIG. 10 is a perspective view of a partially formed girder cage according to the present invention;

FIG. 11 is an enlarged perspective view of one end of the girder cage of FIG. 10 illustrating splice bars ready to charge horizontally through the column cage;

FIG. 12 is an enlarged portion of the end of the girder cage of FIG. 11 better illustrating the spool-type rollers;

FIG. 13 is an elevational end view of the girder cage of FIG. 11;

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1A:
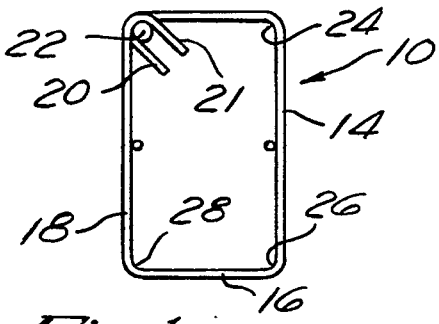
Fig. 1a (PRIOR ART)
FIG. 1*a* is a plan view of a rectangular hoop utilized in prior art column and girder fabrication.
Figure 1B:
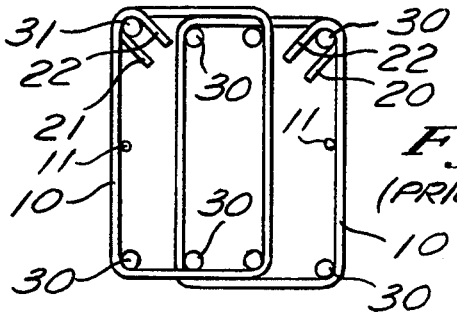
Fig. 1b (PRIOR ART)
FIG. 1*b* is a plan view of two of the rectangular hoops of FIG. 1*a* having ten rebar members charged therethrough according to the prior art.

The ductile frame of the present invention is illustrated in FIGS. 2–19 which depict a presently preferred embodiment of the invention. FIGS. 1*a* and 1*b* depict devices utilized according to prior art construction methodology.

Referring now to FIG. 1*a*, a prior art rectangular hoop 10 is formed from a section of rebar such that it has four sides 12, 14, 16, and 18, and is generally configured as a rectangle. The rectangular hoop has corners 22, 24, 26, and 28. The ends 20 and 21 of sides 12 and 18, respectively, are bent inward such that they may be disposed about either side of a rebar member (31 in FIG. 1*b*) charged through the rectangular hoop 10 and positioned at the corner 22 thereof.

Referring now to FIG. 1*b*, the prior art construction of a column or girder cage is illustrated. Two rectangular hoops 10 are disposed about ten rebar members 11, 30, and 31 such that the rebar members 11, 30, and 31 are captured and contained within the rectangular hoops 10. As is well known to those skilled in the art, a plurality of such rectangular hoops 10 charged with rebar members 11, 30, and 31 thus form a latticework or cage about which concrete is poured to form the desired structural member. Intermediate rebar members 11 are not confined at a corner and are consequently more subject to moving due to this lack of containment than are rebar members 30 and 31.

Figure 2:
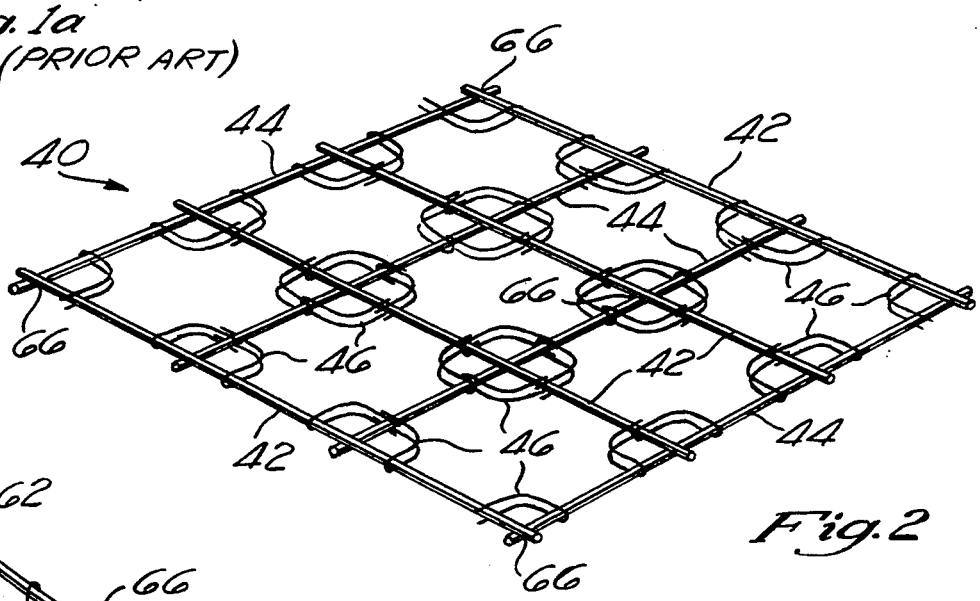
FIG. 2 is a perspective view of a welded grid having pre-positioned ties formed thereon for use in the fabrication of reinforced concrete columns according to the present invention.

Referring now to FIG. 2, a generally square column grid 40 of the present invention is illustrated. The column grid 40 comprises a plurality, i.e. four, of first or longitudinal wire members 42 disposed perpendicularly to a like plurality of second or transverse wire members 44 such that intersections 66, preferably welded joints, are formed. The first 42 and second 44 wire members thus generally define a square. That is, the longitudinal 42 and transverse 44 wire members form plural orthogonal cells. The total area of the grid 40 is approximately equal to, i.e., slightly less than, the cross-sectional area of the structural member, i.e. girder, to be fabricated therefrom.

Disposed at a substantial number, preferably all, of the interior corners formed by the intersections 66 of the longitudinal 42 and transverse 44 wire members are pre-positioned ties 46, preferably formed of wire. Those skilled in the art will recognize that other materials, i.e. plastic, string, cord, tie wraps, perforated plastic ties, etc., are likewise suitable. During the charging process these pre-positioned ties 46 define apertures through which rebar members are charged. After the charging process, these ties 46 firmly secure the charged rebar members in place.

Each pre-positioned tie 46 is firmly attached at one end thereof to a wire member 44 or 42. Those skilled in the art will recognize that various means, e.g. welding, hot glue, etc., are suitable for attaching the ties 46 to the wire members 42 and 44. The other end of each tie 46 is disposed proximate an intersecting wire member 42 or 44 such that after charging, the wire tie may be tightened about the captured rebar member.

The use of such ties 46 with a prefabricated grid 40 make possible high tolerances, i.e., approximately 1/16 inch, in the positioning of the rebar members charged therethrough. Such close tolerance positioning of the rebar charged through the grids 40 minimizes metal usage, improves structural strength, and reduces the amount of time and labor required to form the structural members.

The uniformly constant confinement provided by the present invention's tight tolerance fabrication gives the reinforced concrete member much greater ductility than is present in the prior art. These consistently exact dimensions improve the reliability of the reinforced concrete structure and permit it to withstand violent earthquake forces.

The more exact dimensions of the grids of the present invention provide for the use of automated fabrication and assembly methods. They thus reduce the time required for erection, as well as for the connection of the cages and precast members of the present invention.

The increase ductility of the structural members of the present invention makes them more resistant to lateral seismic forces. Thus, the members can be constructed utilizing significantly less concrete and steel while maintaining the same earthquake resistance.

Figure 3:
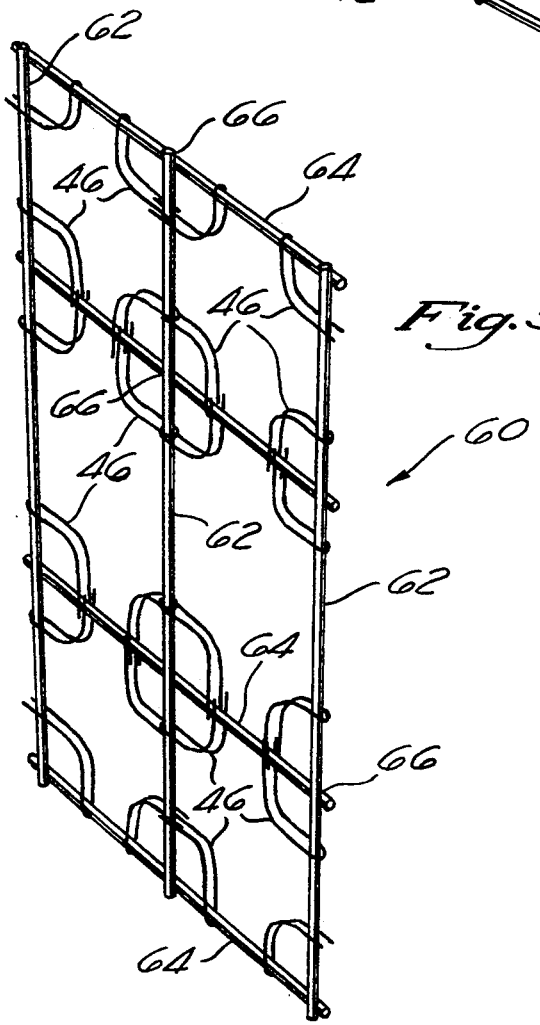
FIG. 3 is a perspective view of a welded grid having pre-positioned ties formed thereon for use in the fabrication of reinforced concrete girders according to the present invention.

Referring now to FIG. 3, a generally rectangular grid 60 for use in the formation of girders 130 (best shown is FIGS. 10 and 15) of the present invention is illustrated. The girder grid 60 comprises a plurality, i.e., three, first or vertical wire members 62 disposed perpendicularly to a plurality, i.e., four, of second or horizontal members 64. As in the column grids 40, pre-positioned wire ties 46 are formed at the interior corners of intersecting wire members 62 and 64 and provide like benefits.

Figure 3A:
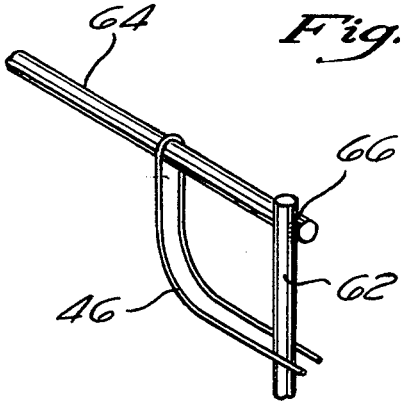
FIG. 3*a* is an enlarged perspective view showing the intersection of two rebar members representative of those of FIGS. 2 or 3 and illustrating the positioning of a wire tie formed thereon.

Referring now to FIG. 3*a*, the intersection 66 of two wire members 62 and 64 having a pre-positioned tie 46 attached thereto is illustrated. A weld joint preferably interconnects the two wire members 62 and 64. Such welded construction is preferably utilized in both the column grids 40 of FIG. 2 and the girder grids 60 of FIG. 3, because of the high strength union formed thereby. Alternatively, the column 40 and girder 60 grids may be formed by molding, machining, utilizing fasteners, or forging. Those skilled in the art will recognize that various other materials and methods of forming prefabricated integral, one-piece, grids are likewise suitable.

An assembly fixture is utilized to hold the longitudinal 42 and transverse 46 wire members of the column grid 40 or the vertical members 62 and horizontal members 64 of the girder grid 60 in position while the wire members 42 and 46 or 62 and 64 are interconnected and/or the ties 46 are attached thereto.

A substantial savings in weight is realized in the practice of the present invention because use of the prefabricated column 40 and girder 60 grids eliminates the ends 20 and 21 of the rectangular hoops 10 (as shown in FIGS. 1 and 2) which are present in the prior art. Because of the large number of such rectangular hoops 10 utilized in the construction of any given structural member, this savings is indeed substantial. Labor is also saved by reducing the number of pieces that the worker must install.

The elimination of the ends 20 and 21 of the prior art rectangular hoops 10 facilitates passage of the wet concrete through the grids of the present invention. It also enhances the vibration process such that voids are better eliminated in the present invention. Thus, concrete flow is improved and the integrity of the structural member is enhanced. More rebar can be used in smaller members without inhibiting the pouring and vibrating of the wet concrete. Thus, smaller members have greater weight bearing capacity.

Strength is improved since every rebar member is confined within a welded corner or welded T intersection of the grid. There is no non-welded or weak corner which is particularly subject to failure during seismic activity.

Because of the accuracy and rigidity with which the steel reinforcing lattices or cages of the present invention are formed, they do not tend to distort or corkscrew as they are being erected. The resulting rigidity and high tolerance construction of the steel cages therefore substantially enhances and improves the erection process. Thus, the erection process requires less time and is consequently less costly.

Referring now to FIG. 4, an interconnection module 80 is illustrated. The interconnection module 80 comprises a plurality of first 82 and second 84 perpendicularly intersecting horizontal wire members, preferably defining prefabricated grids. The intersecting first 82 and second 84 wire members define a plurality of separate planes which are interconnected via a plurality of third or vertical members 86. Three alignment members 88 are preferably positioned vertically upon each vertical face of the interconnection module 80 to define the position at which a girder is attachable. An angle bracket 90 having upper 92 and lower 94 perpendicular edges is attached at the lowermost portion of each of the four vertical faces of the intersection module 80 to facilitate abutting attachment of girders thereto. Adjacent angle brackets, i.e., those on adjacent faces of the interconnection module are preferably formed at different heights or offsets relative to one another. These offsets prevent the rebar members of perpendicularly intersecting girders from interfering with each other.

Thus, a girder cage 130 (FIG. 10) may be attached to a column cage 150 (FIG. 9) having an intersection module 80 formed thereon by positioning one edge of the girder cage 130 upon the lower edge 94 of the angle bracket 90 and aligning the girder cage 130 with the alignment members 88. Alignment of the vertical wire members 62 of the girder cage 130 with the vertical alignment members 88 of the interconnection module 80 is thus attained. Ties may then be utilized to connect the girder cage 130 to the interconnection module 80. The weight of the girder cage 130 may be supported by the angle bracket 90 during the attachment process. Attachment of the girder 130 to the column having the interconnection module 80 formed thereon is further accomplished by extending splice sections of rebar along the girder rebar members charged through the column girder 130 and attaching the splice sections of rebar thereto, generally via ties, preferably wire ties. Girder rebar splice bars are changed horizontally through the column cage 150. The girder splice bars are tied to the girder cage bars. A minimum of eight feet of splice rebar is generally desired within the girder cage 130 being attached to the column cage 150.

Splice member overlap length reduction is achieved due to better confinement. Because of the uniform confinement among the full length of the splice, tests have shown that the required lap length is much less than that required by code. Consequently shorter overlaps save a substantial amount of reinforcement steel. If an opposing girder cage 130 is attached to the interconnection module 80, then the splice sections of rebar extend through the interconnection module 80 such that they are attached to both opposing girder cages 130.

Referring now to FIG. 4*a*, the welded interconnection 85 of the first 82, second 84, and third 86 rebar members is illustrated. Welded construction is preferred, although those skilled in the art will recognize that various other methods are likewise suitable.

Referring now to FIGS. 5 and 5*a*, an expandable cage or grid bundle 100 is comprised of a plurality of individual column grids 40. The grids 40 are attached together via loops 102 disposed about adjacent rebar members, i.e. adjacent horizontal wire members 44 and/or adjacent vertical rebar members 42. The loops 102 limit the expansion of the wire cage 100 and define the final positions of the grids 40. The grids 40 preferably expand such that adjacent grids are approximately three inches apart after expansion. Similar construction is utilized in fabrication of an expandable cage or grid bundle comprised of girder grids 60. The loops 102 are preferably comprised of steel, however, those skilled in the art will recognize that various other materials, e.g. copper, aluminum, plastic, rope, fabric, etc., are likewise suitable. Additionally, tie wraps and/or perforated plastic wraps may be utilized as the loops 102.

The column grids 40 (as well as the girder grids 60) can be configured such that they may be nested for storage and transportation. Nesting allows each grid to be positioned as close as possible to adjacent grids, such that a compact assembly is formed. To nest the column grids 40, for example, every other column grid 40 is turned around such that the first wire members 42, for example, are disposed next to each other, i.e., one above and one below. Thus, for each such turned grid, the length of the assembly is reduced by the diameter of the wire member 42 and space is correspondingly conserved.

The entire expandable cage or grid bundle, whether in a nested configuration or not, is preferably shrink-wrapped to facilitate handling. Shrink wrapping envelopes the grid bundle with plastic to prevent movement of the grids relative to one another during shipping and handling, as well as during the cage assembly process.

Referring now to FIGS. 6, 6*a*, and 6*b*, a horse 110 supports upper elongate rebar sections 112. Lower rebar sections 113 may be supported, as required. The horse comprises parallel base bars 210 which extend the distance of the structural member to be formed thereupon, vertical support bars 212, and cross members 214 adjustably attached to the vertical support members 212. Base cross members 218 interconnect the base members 210.

With particular reference to FIG. 6*a*, the height of each cross member 214 can be varied by loosening adjustable fittings 216 and sliding the cross member 214 up or down as desired. Retightening the adjustable fitting 216 firmly secures the cross member 214 in place.

With particular reference to FIG. 6*b*, adjustable support 220 comprising support surface 222 disposed atop adjustable vertical support members 224 and attached to cross member 226 may be utilized to support the interconnection modules 80. As with the adjustable cross members 214, the height of the support surface 222 is adjustable via adjustment couplings 228.

Adjacent interconnection modules 80 are preferably spaced approximately three feet six inches apart. Such horses 110 are utilized to support sections of rebar during the charging process wherein columns and girders are formed according to both the prior art and present invention.

Referring now to FIGS. 7 and 8, horses 110 are illustrated supporting two elongate rebar sections 112, preferably formed of #11 rebar. Those skilled in the art will recognize that various other sizes of rebar may likewise be suitable. A plurality of expandable grids 100, preferably still shrink-wrapped, depend from the rebar sections 112. Similarly, a plurality of interconnection modules 80 depend from the rebar sections 112. Each interconnection module 80 is preferably further supported by a support 220 (FIG. 6*b*). The expandable bundles 100 expand to fill the distance between interconnection modules 80 in the manner illustrated in FIG. 5*a*. Columns up to sixty feet in height, the standard uncut length of rebar as purchased from the mill, can easily be fabricated utilizing the process of the present invention.

With particular reference to FIG. 8, the charging process is illustrated. During charging, a plurality of additional elongate rebar sections 116, preferably likewise formed of #11 rebar, are pushed through the openings of the expandable cages or grid bundles 100 and interconnection modules 80. Charging is preferably performed with the grid bundles 100 still shrink-wrapped. By charging the grid bundles 100 while they are still shrink wrapped, the individual grids comprising the bundles are maintained in a desired, i.e. collapsed or nonexpanded, configuration which facilitates their handling and thus makes the charging process easier. This is accomplished by pushing the rebar sections 112 and 116 through the plastic shrink wrap. The shrink wrap is removed prior to expanding the grid bundle 100.

Each of the elongate rebar sections 112 and 116 pass through the ties 46 of the individual grids 40 comprising the grid bundle 100. The ties 46 are tightened after expanding the expandable grid bundle 100 to securely attach the individual grids 40 to the charged rebar members 112 and 116. Interconnection modules 80 are similarly attached at the desired locations along the charged rebar sections.

After a steel reinforcing cage is formed as described above, forms, typically comprised of fiberglass or steel, are secured about the latticework or cage and concrete is then poured into the forms. As in prior art structural member construction, the concrete substantially encapsulates the steel cage. Although the fabrication of a column cage according to the method of the present invention is described above, the method of fabricating a girder cage is an analogous process wherein girder grids 60 are substituted for the column grids 40.

After pouring the concrete into the form, it is typically vibrated to minimize voids or air pockets formed therein during the pouring process. Use of the column grids 40 or girder grids 60 of the present invention enhance both the pouring and void elimination processes. Pouring is facilitated by eliminating extraneous protuberances which would otherwise inhibit the flow of concrete through the steel latticework of the cage. The locked ends 20 and 21 of the rectangular hoops 10 (shown in FIGS. 1*a* and 1*b*) are eliminated. Theses superfluous members represent a substantial impedance to the flow of concrete through the steel latticework due to their large number. Furthermore, the amount of steel utilized in wire ties is reduced both by maximizing the efficiency of the attachment process through the use of pre-positioned wire ties 46 and by utilizing prefabricated column 40 and girder 60 grids. The vibration or void elimination process is likewise enhanced through the elimination of superfluous steel since such protruding steel both contributes to the formation of voids and inhibits their elimination.

Referring now to FIG. 9, an interconnection module 80 having a plurality of elongate rebar sections 112 and 116 charged therethrough is illustrated. As can be seen, the rebar sections 112 and 116 extend through the openings in the interconnection module 80. The interconnection module 80 may be secured to the elongate rebar members 112 and 116 via ties. Those skilled in the art will recognize that various other means, i.e. welding, for securing the interconnection module 80 to the rebar members 112 and 116 are likewise suitable.

Referring now to FIGS. 10–13, a girder cage 130 constructed according to the present invention is illustrated. The girder generally comprises a plurality of rebar members 132, preferably #11, charged through a plurality of girder grids 60, at the corners thereof. Additionally, rebar members 133 are charged intermediate the corner rebar members 132.

Additionally, cross members 134 and spool-type rollers 136 (best shown in FIG. 12) may optionally be provided to improve the charging process. The cross members 134 are welded at the appropriate heights along selected vertical rebar members 62 of girder grids 60 to provide proper support for the rebar members 132 charged therethrough. Rollers 136 are comprised of first 138 and second 140 rebar supporting portions, each disposed outboard of corresponding partitions 142. The partitions 142 maintain positioning of the associated rebar sections 132. The spool-type rollers 136 preferably comprise a metal material, i.e. steel, although they may alternatively comprise a plastic material, preferably a low-friction plastic material such as TEFLON (a registered trademark of Du Pont de Nemours, E. I., & Co., Inc.). Those skilled in the art will recognize that various other materials are likewise suitable. Ties 46 secure elongate rebar sections 132 in position after they have been charged through the girder grids 60.

Figure 14:
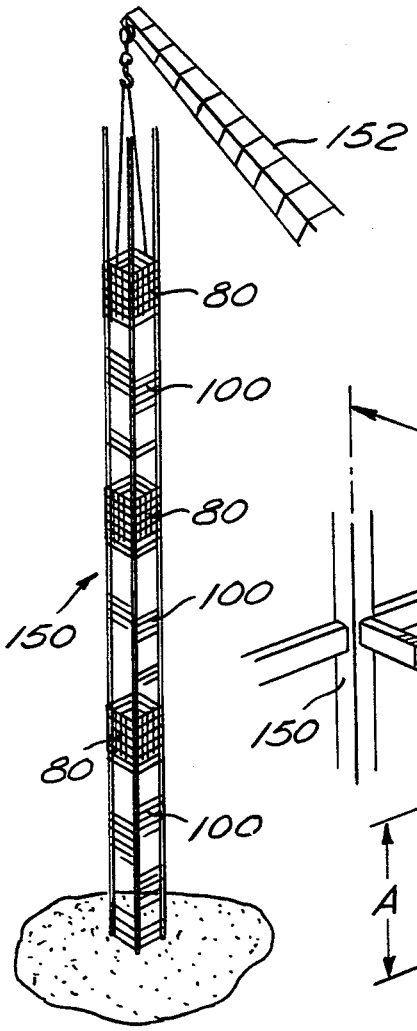
FIG. 14 is a perspective view of a column cage being lifted by a crane into its final position.
Figure 18:
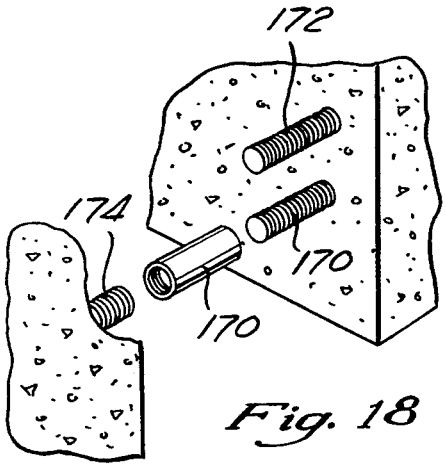
FIG. 18 is a perspective view illustrating the use of a threaded coupling to interconnect a precast concrete column and a precast concrete girder utilizing the cages of the present invention.
Figure 19:
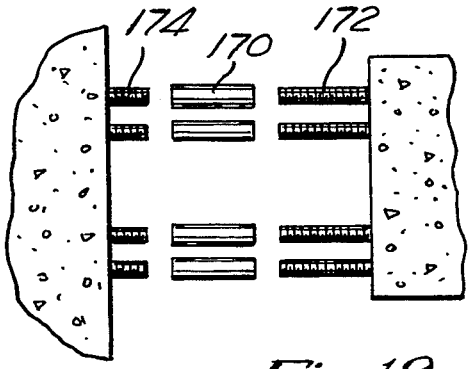
FIG. 19 illustrates the use of a plurality of threaded couplings to interconnect a column and a girder.

Referring now to FIG. 14, a column cage 150, such as that being assembled in FIGS. 7 and 8, is being positioned by crane 152. The expandable grid bundles 100 have been expanded and secured in position via ties 46. The interconnecting modules have likewise been secured in position with ties 46. If concrete is applied prior to erection, then rebar couplers, as shown in FIGS. 18 and 19, must be used to connect column section to column section and girders to columns.

Figure 15:
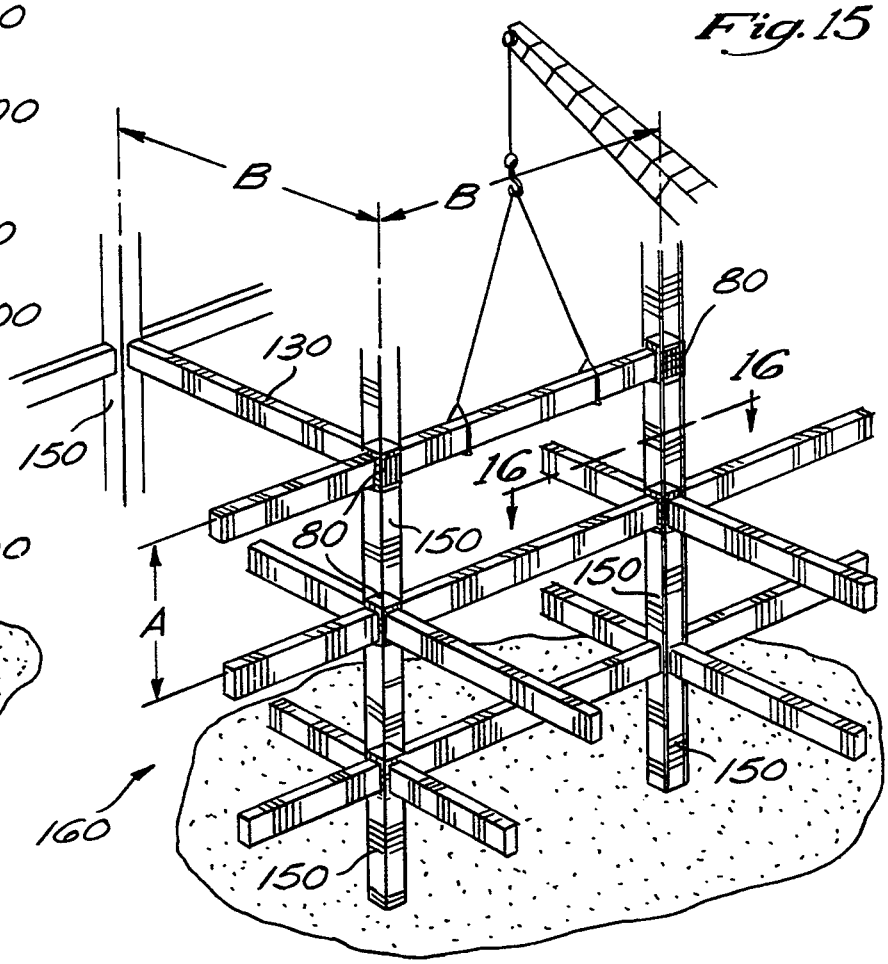
FIG. 15 is a perspective view of a plurality of column cages and girder cages attached together via interconnection modules to define a portion of a ductile frame for a building.

Referring now to FIG. 15, a ductile frame 160 is comprised of columns 150 and girders 130. The girders 130 are attached to the columns 150 at interconnection modules 80. Distance "A" between adjacent girders is preferably approximately thirteen feet and distance "B" between adjacent columns is preferably approximately 30 feet. When a tall building must accommodate below-grade parking, columns must be spaced at approximately thirty feet on center in both directions.

Figure 16:
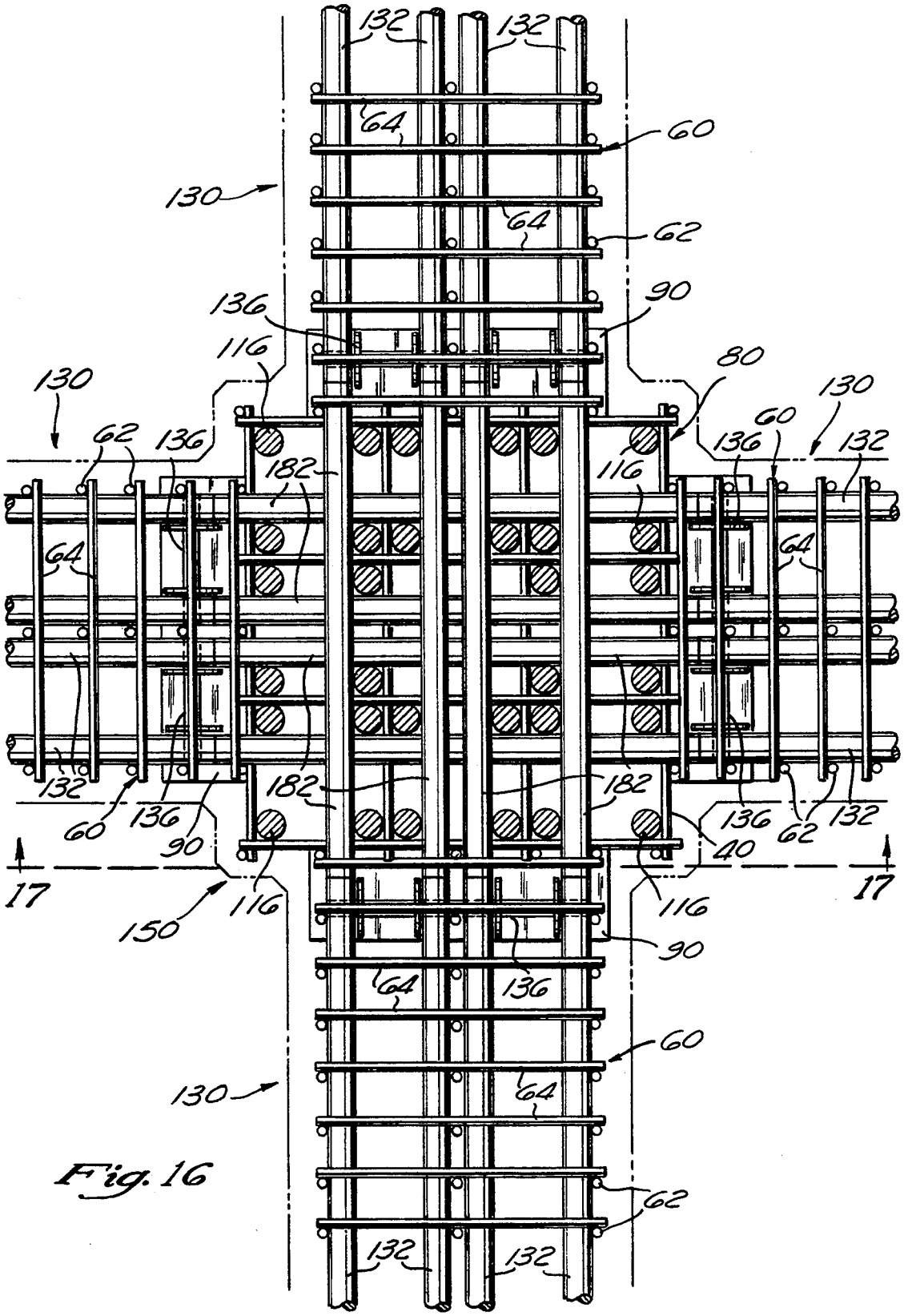
FIG. 16 is a top plan view of an interconnection module attaching four girder cages to a column according to the present invention.
Figures 17, 17A:
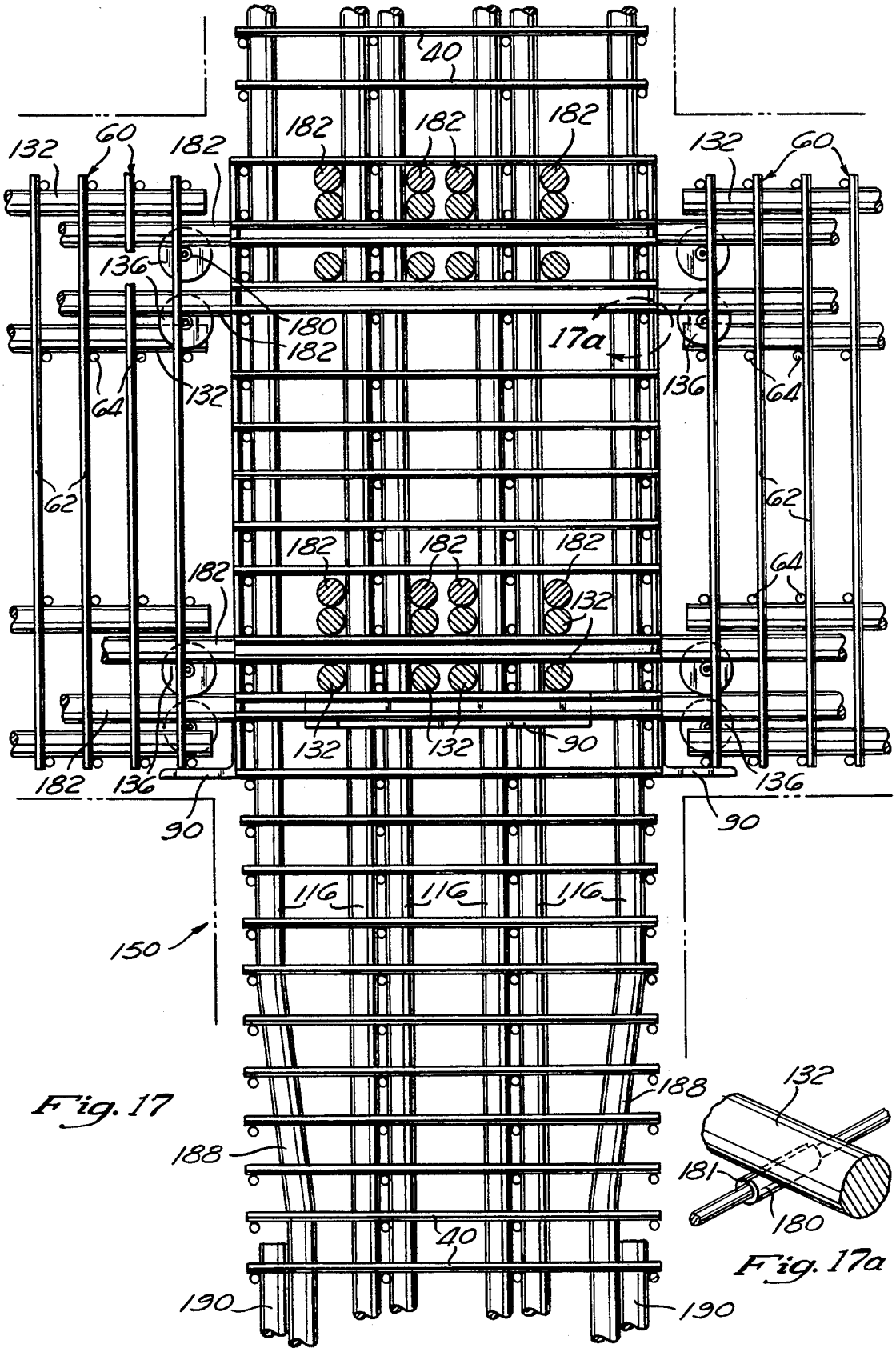
FIG. 17 is an elevational side view of the column, girders, and interconnection module of FIG. 16.
FIG. 17*a* is an enlarged perspective view of a split-sleeve snap-on roller for facilitating charging of the columns, girders, or interconnection module with rebar.

Referring now to FIGS. 16, 17, and 17*a*, the steel structures or lattices associated with the interconnection of girders 130 and columns 150 are illustrated. Split-sleeve snap-on rollers 180 (as best shown in FIG. 17*a*) may optionally be installed upon any rebar members having other rebar members charged thereover to facilitate such charging. Such split-sleeve snap-on rollers preferably comprise a metal material, such as steel. However, they may alternatively comprise a plastic material, such as TEFLON. Those skilled in the art will recognize that various other materials are likewise suitable.

The split-sleeve snap-on roller is preferably configured such that the split 181 may be pried apart or opened sufficiently to facilitate attachment thereof to a rebar member or the like. Thus, such split-sleeve snap-on rollers are disposable upon preformed column grids 40, and interconnection modules 80 in order to facilitate the charging of rebar members therethrough.

Splice rebar members 182 interconnect opposing girders 130. The splice rebar members 182 are disposed parallel to and adjacent the rebar members 132 comprising the girder cage. The splice rebar members 182 are attached to the rebar members 132 of the girder cages via ties. Those skilled in the art will recognize that various other means of attaching the splice rebar members 182 to the girder rebar members 132 are likewise suitable.

The rebar members 116 of the column 150 further comprise tapered portions such that they may readily interconnect to additional column rebar cage members 190 for attachment thereto. Each attachment may be accomplished via ties. Those skilled in the art will recognize that various other means for attachment are likewise suitable.

Referring now to FIGS. 18 and 19, the use of a threaded coupling 170 to interconnect columns and/or girders is illustrated. The threaded coupling 170 is initially threaded completely onto first threaded rebar members 172 which are partially embedded within a column 150 or a girder 130. Complimentary second threaded studs 174 are positioned in alignment and abutting relation to the first threaded studs 172 upon which the threaded couplings 170 are attached. The threaded couplings 170 are then unthreaded partially from the first threaded studs 172 such that they thread upon the complimentary second threaded studs 174, thereby interconnecting the first threaded studs 172 and the complimentary second threaded studs 174. The threaded couplings may optionally comprise a ductile material or mechanism to facilitate minor relative motion between the columns and/or girders joined thereby.

It is understood that the exemplary ductile frame described herein and shown in the drawings represents only a presently preferred embodiment of the invention. Indeed, various modifications and additions may be made to such embodiment without departing from the spirit and scope of the invention. For example, the grids may be comprised of various materials and formed by various processes which provide a high strength, integral construction. Also, members other than contemporary rebar, i.e. angle iron, square tubing, etc., may be utilized in the construction of the present invention. Furthermore, the grids need not be rectangular in shape, but rather need only conform generally in shape to the cross-section of the structural member being fabricated therewith. Additionally, those skilled in the art will recognize that stay-in-place forms may be utilized in the construction of columns, beams, and similar construction members according to the present invention. The structures and methodology of the present invention need not be limited to use in the fabrication of columns and girders. Rather, those skilled in the art will recognize that the structures and methodology of the present invention may be utilized in the construction of various other structural members as well. Thus, these and other modifications and additions may be obvious to those skilled in the art and may be implemented to adapt the present invention for use in a variety of different applications.

What is claimed is:

1. A ductile reinforced concrete construction member comprising:

(a) a plurality of prefabricated grids disposed in generally parallel stacked relationship;
(b) a plurality of rebar members charged through said prefabricated grids; and
(c) concrete generally encapsulating said grids and rebar members;
(d) at least one roller formed upon at least one of said grids such that at least one of said rebar members may be charged through said grid thereover, said roller reducing friction between said rebar member and said grid to enhance the charging process prior to encapsulation of said grids and said rebar members in concrete.

2. The ductile reinforced concrete construction member as recited in claim 1 wherein said roller comprises a plurality of partitions, said rebar members being separated from one another by said partitions.

3. The ductile reinforced concrete construction member as recited in claim 1 wherein said roller comprises a split-sleeve snap-on roller which is attachable to said grid.

4. A grid for use in the fabrication of ductile reinforced concrete construction members, said grid comprising:
(a) a plurality of first generally parallel steel wire members;
(b) a plurality of second generally parallel steel wire members welded to said plurality of first generally parallel steel wire members, said first wire members being generally perpendicular to said second wire members such that intersections thereof are formed;
(c) said first and second wire members defining a rectangle; and
(d) at least one roller disposed upon at least one of said first and second wire members such that at least one rebar member may be changed through said grid thereover, said roller reducing friction between said rebar member and said grid to enhance the changing process.

5. The grid as recited in claim 4 wherein said roller comprises at least one partition.

6. The grid as recited in claim 4 wherein said roller comprises a split-sleeve snap-on roller which is attachable to said grid.

7. A ductile reinforced concrete construction member comprising:
a) a plurality of prefabricated grids disposed in generally parallel stacked relationship, each of said grids comprised of intersecting first and second rebar members;
b) a plurality of third rebar members charged through said prefabricated grids;
c) concrete generally encapsulating said grids and rebar members; and
d) a plurality of wire ties disposed at a plurality of the intersections of said first and second rebar members, one end of said wire ties being attached firmly to the first rebar member and the opposite end thereof being attached loosely to the second rebar member to facilitate tightening thereof about said third rebar members charged through said grids.

8. The ductile reinforced concrete construction member as recited in claim 7 wherein said wire ties are attached firmly to the first rebar member via at least one of welding and hot glue.

9. The ductile reinforced concrete construction member as recited in claim 7 further comprising a plurality of links interconnecting adjacent grids for defining a distance therebetween,

10. The ductile reinforced concrete construction member as recited in claim 4 wherein said links comprise wire links.

11. The ductile reinforced concrete construction member as recited in claim 7 further comprising at least one roller formed upon at least one of said grids such that at least one of said rebar members may be charged through said grid thereover, said roller reducing friction between said rebar member and said grid to enhance the charging process.

12. The ductile reinforced concrete construction member as recited in claim 11 wherein said roller comprises a plurality of partitions, said rebar members being separated from one another by said partitions.

13. The ductile reinforced concrete construction member as recited in claim 11 wherein said roller comprises a split-sleeve snap-on roller which is attachable to said grid.

14. A ductile reinforced concrete construction member comprising:
a) a plurality of prefabricated grids disposed in generally parallel stacked relationship, each of said grids comprised of intersecting first and second rebar members;
b) a plurality of links interconnecting adjacent generally parallel stacked grids for defining a distance therebetween;
c) a plurality of third rebar members charged through said prefabricated grids;
d) concrete generally encapsulating said grids and rebar members; and
e) a plurality of wire ties disposed at a plurality of the intersections of said first and second rebar members, one end of said wire ties being attached firmly to the first rebar member and the opposite end thereof being attached loosely to the second rebar member to facilitate tightening thereof about said third rebar members charged through said grids.

15. The ductile reinforced concrete construction member as recited in claim 14 wherein said links comprise wire links.

16. A ductile reinforced concrete construction member comprising:
a) a plurality of prefabricated grids disposed in generally parallel stacked relationship, each of said grids comprised of intersecting first and second rebar members;
b) a plurality of third rebar members charged through said prefabricated grids;
c) at least one roller formed upon at least one of said grids such that at least one of said third rebar members may be charged through said grid thereover, said roller reducing friction between said rebar member and said grid to enhance the charging process;
d) concrete generally encapsulating said grids and rebar members; and
e) a plurality of wire ties disposed at a plurality of the intersections of said first and second rebar members, one end of said wire ties being attached firmly to the first rebar member and the opposite end thereof being attached loosely to the second rebar member to facilitate tightening thereof about said third rebar members charged through said grids.

17. The ductile reinforced concrete construction member as recited in claim 16 wherein said roller comprises a plurality of partitions, said rebar members being separated from one another by said partitions.

18. The ductile reinforced concrete construction member as recited in claim 16 wherein said roller comprises a split-sleeve snap-on roller which is attachable to said grid.

* * * * *